US006178993B1

(12) United States Patent
Oberdorfer

(10) Patent No.: US 6,178,993 B1
(45) Date of Patent: Jan. 30, 2001

(54) COVERING ROSETTE

(75) Inventor: Hans Oberdorfer, Stuttgart (DE)

(73) Assignee: Hansa Metallwerke AG (DE)

( * ) Notice: Under 35 U.S.C. 154(b), the term of this patent shall be extended for 0 days.

(21) Appl. No.: 09/447,906

(22) Filed: Nov. 23, 1999

(30) Foreign Application Priority Data

Nov. 23, 1998 (DE) ..... 198 53 950

(51) Int. Cl.[7] ..... F16L 5/00
(52) U.S. Cl. ..... 137/359; 137/360; 137/356
(58) Field of Search ..... 137/360, 359, 137/356

(56) References Cited

U.S. PATENT DOCUMENTS

| | | | | |
|---|---|---|---|---|
| 4,298,020 | * | 11/1981 | Inada et al. | 137/315 |
| 4,989,278 | * | 2/1991 | Kostorz | 4/676 |
| 5,161,567 | * | 11/1992 | Humpert | 137/359 |
| 5,263,853 | * | 11/1993 | Pall | 137/382 |
| 5,447,338 | * | 9/1995 | Kikuchi | 285/46 |

* cited by examiner

*Primary Examiner*—A. Michael Chambers
*Assistant Examiner*—Thomas L. McShane

(57) ABSTRACT

A covering rosette (4) for a sanitary wall-fitting comprises, in a manner known as such, a covering plate (6) which is capable of being fastened to the wall-fitting and an ornamental hood (5) which is detachably fastened to the covering plate (6). Covering plate (6) and ornamental hood (5) are each provided with passage openings (8, 18) for a region of the wall-fitting onto which an ornamental cap (1) is capable of being pushed from outside. On the covering plate (6) and/or on the ornamental hood (5) at least one spring shackle (25) is provided, the boundary surface **(25*c*) of which pointing towards the axis of the passage openings (8, 18) is situated in the tension-free state on a circle, the diameter of which is equal to or smaller than the outside diameter of the push-on ornamental cap (1). In addition, the spring shackle (25) is provided on its outer boundary surface (25*d*) with a latching device which interacts with a complementary latching device (30) on the respective other part (ornamental hood (5) or covering plate (6)) in such a manner that with the ornamental cap (1) pushed on the latching devices (25*d*, 30)** cannot be detached from one another.

8 Claims, 9 Drawing Sheets

COVERING ROSETTE

Figure 1:
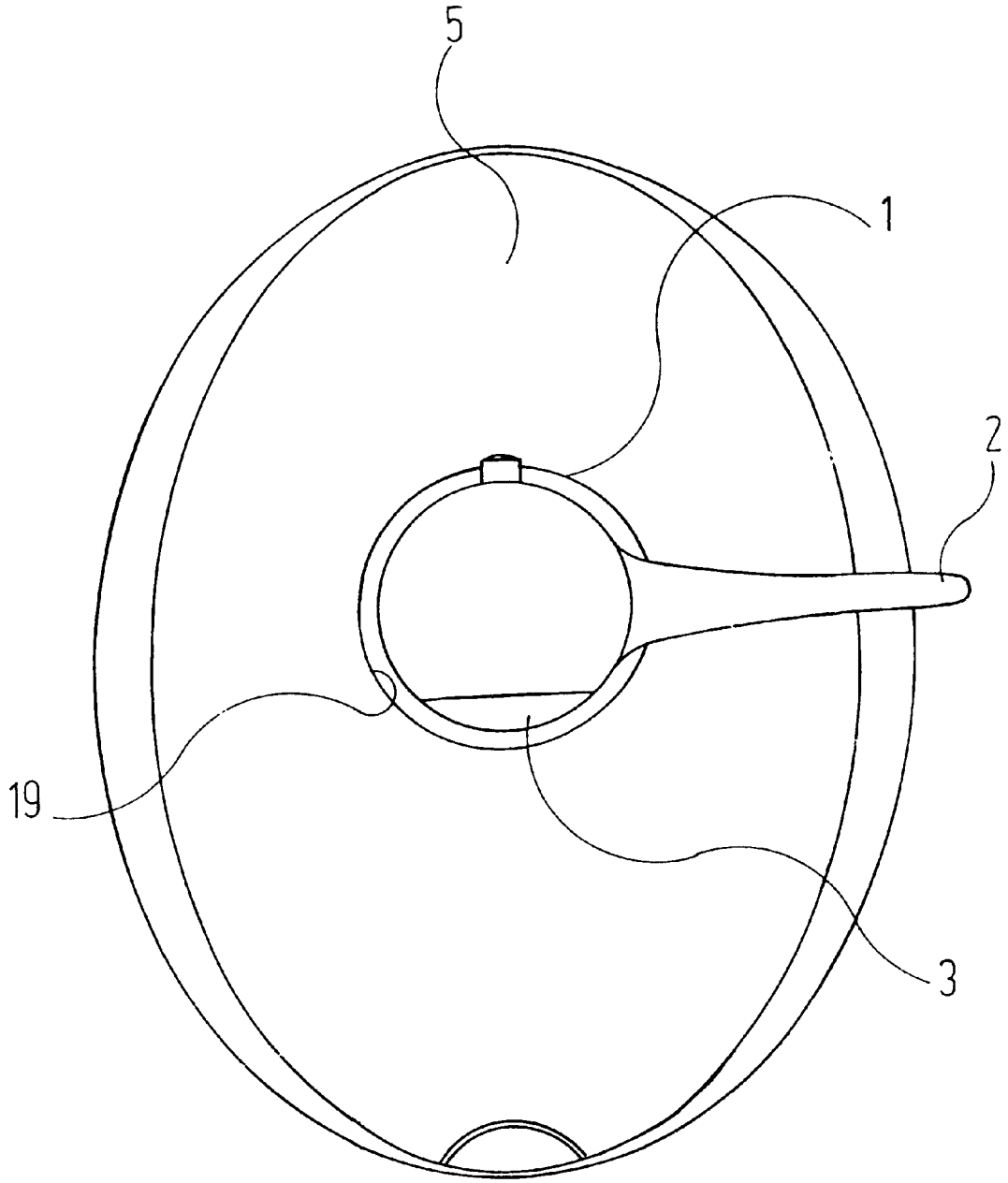

The invention relates to a covering rosette for a sanitary flush-mounted fitting with a covering plate which is fastened to the flush-mounted fitting and with an ornamental hood which is detachably fastened to the covering plate, whereby covering plate and ornamental hood exhibit coaxial passage openings for a region of the flushmounted fitting onto which an ornamental cap is capable of being pushed from outside.

Covering rosettes of this type serve for protection of the flush-mounted fitting against spray and simultaneously serve to cover, in visually appealing manner, the transition region between the region of the flush-mounted fitting protruding from the wall and the wall section adjacent to said region.

A covering rosette of the type mentioned in the introduction is known from EP 0 485 842 B1. It comprises a covering plate, which for the purpose of fastening is screwed on the flush-mounted fitting, as well as an ornamental hood. The ornamental hood exhibits moulded-on pushbutton-like spigots with which it locks in position in openings in the covering plate for detachable fastening. The point of this type of fastening is to conceal the connecting means with which the ornamental hood is fixed to the covering plate from the view of the observer.

With covering rosettes of this type a certain dilemma arises: on the one hand the ornamental hood is to be capable of being fastened to the covering plate with little expenditure of force and, still more important, is also to be capable of being redetached from the covering plate with little expenditure of force. On the other hand of course, the ornamental hood is not to be capable of being detached from the covering plate unintentionally. The covering rosette described in EP 0 485 842 B1 cannot satisfy both requirements simultaneously.

The object of the present invention is to configure a covering rosette of the type mentioned in the introduction in such a manner that, on the one hand, the ornamental hood is capable of being fixed to the covering plate and capable of being redetached from the latter with very little expenditure of force, but, on the other hand, the risk of unintentional detachment of the ornamental hood from the covering plate is ruled out.

In accordance with the invention this object is achieved by at least one spring shackle being provided on the covering plate and/or on the ornamental hood, the boundary surface of which pointing towards the axis of the passage openings pertaining to covering plate and ornamental hood is situated in the tension-free state on a circle which is concentric with the passage openings, the diameter of which circle is equal to or smaller than the outside diameter of the push-on ornamental cap, and which exhibits on the boundary surface pointing away from the axis of the passage openings a latching device which interacts with a complementary latching device on the respective other part (ornamental hood or covering plate) in such a manner that the latching devices cannot be detached from one another when the ornamental cap is pushed on.

The basic idea according to the invention is the following: if one of the two parts of the covering rosette (that is to say, either the covering plate or the ornamental hood) is provided with a spring shackle which is capable of being latched with its outward-pointing boundary surface on the respective other part (ornamental hood or covering plate), then it is possible for this latching connection to be released only by the spring shackle being distorted radially inwards in the direction of the axis of the passage openings pertaining to covering plate and ornamental hood. The invention recognises that this degree of freedom which is required for bringing about or releasing the latching connection can, with certain flush-mounted fittings, be blocked or released in the following way: the flush-mounted fittings in question exhibit an ornamental cap which in the course of final mounting of the fitting in a conclusive step is pushed from outside as an optical decorative part over those parts of the fitting which extend out of the wall and through the passage openings in the covering rosette. Now if the spring shackle is configured and dimensioned in the manner according to the invention, then with the ornamental cap inserted the spring shackle cannot execute the compensating movement which is necessary for bringing about and releasing the latching connection. With the ornamental cap inserted, the latching connection between ornamental hood and covering cap, which leads over the spring shackle, is accordingly "locked". With the flush-mounted fitting completely mounted in the ready-to-use state, the ornamental hood is therefore no longer capable of being removed from the covering plate by traction. If the ornamental hood is to be detached from the covering plate it is necessary to remove the ornamental cap of the flush-mounted fitting beforehand. But then the ornamental hood can be very easily taken off from the covering plate.

Particularly preferred is that configuration of the invention in which the boundary surface of the spring shackle pointing towards the axis of the passage openings is situated in the tension-free state on a circle, the diameter of which is smaller than the outside diameter of the ornamental cap to be pushed on, this boundary surface being of spherically convex form. With this configuration the spring shackle accordingly projects into the path of the pushing-on movement of the ornamental cap. Only when this ornamental cap is pushed on is said spring shackle brought into that final position in which the latching connection is "firm". This "pushing-back" of the spring shackle in the radial direction is facilitated by the spherically convex configuration of the boundary surface of the spring shackle adjacent to the ornamental cap. With this dimensioning of the spring shackle it can be ensured that in the tension-free state the interacting latching devices do not engage one another. This means that pushing the ornamental hood onto the covering plate or taking the ornamental hood off from the covering plate is possible with practically no expenditure of force when the ornamental cap of the flush-mounted fitting is removed.

Alternatively it is, of course, conceivable that the latching devices already engage one another, more or less, also in the case where the spring shackle is tension-free, whereby it can be determined by the extent of the interengagement and by the form of the interacting latching, faces how great the force is that has to be applied in the course of pushing on or detaching the ornamental hood.

The interacting latching devices are advantageously constituted by a plurality of flutes which are situated on a cylindrical circumferential surface. This means that the ornamental hood can be fixed to the covering plate at differing distances, as a result of which dimensional inaccuracies with respect to the covering plate and/or the ornamental hood as well as irregularities of the mounting-wall can be compensated.

A particularly reliable fixing of the ornamental hood on the covering plate is obtained when a plurality of spring shackles are integrally formed with a clamping ring which is fastened to the covering plate or to the ornamental hood. The "locking" which is brought about by this plurality of spring shackles when the ornamental cap is inserted then takes place at several places about the axis of the passage openings.

From the point of view of manufacture, that embodiment of the invention in which the ornamental hood is flange-mounted onto the clamping ring is particularly simple. In the case of the ornamental hood it is generally a question of a metallic part, whereas the clamping ring consists, as a rule, of synthetic material. Flange-mounting is a particularly favourable process for bringing about a connection between these parts which consist of different materials.

Each spring shackle may exhibit a curved transition region which is moulded at one end onto the ring body of the clamping ring and is connected at the other end to a latching region which bears the boundary surface pointing relatively towards the axis of the passage openings and the boundary surface pointing away from the axis of the passage openings. This curved transition region facilitates the "compensating movement" taking place in the radial direction (relative to the passage openings pertaining to covering plate and ornamental hood) which the spring shackles have to execute in the course of locking and in the course of releasing the interacting latching devices.

In the inner circumferential surface of the clamping ring a groove may be formed in which an O-ring is situated. This O-ring not only serves to prevent penetration of water between the ornamental cap and the covering rosette into the space located behind it; at the same time it forms a "friction brake" which retains the ornamental cap of the flush-mounted fitting within the covering rosette.

Figure 2:
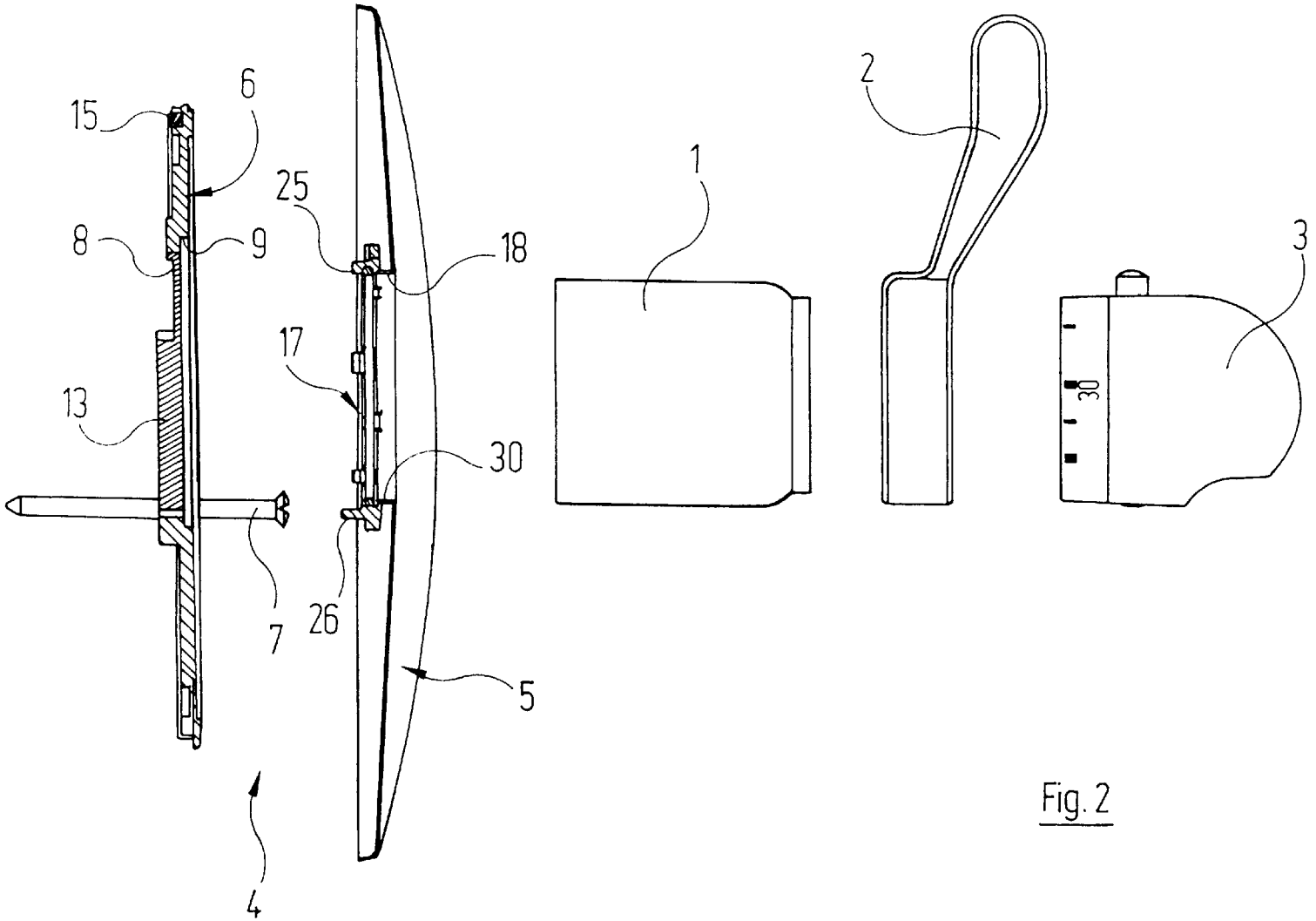
Figure 3:
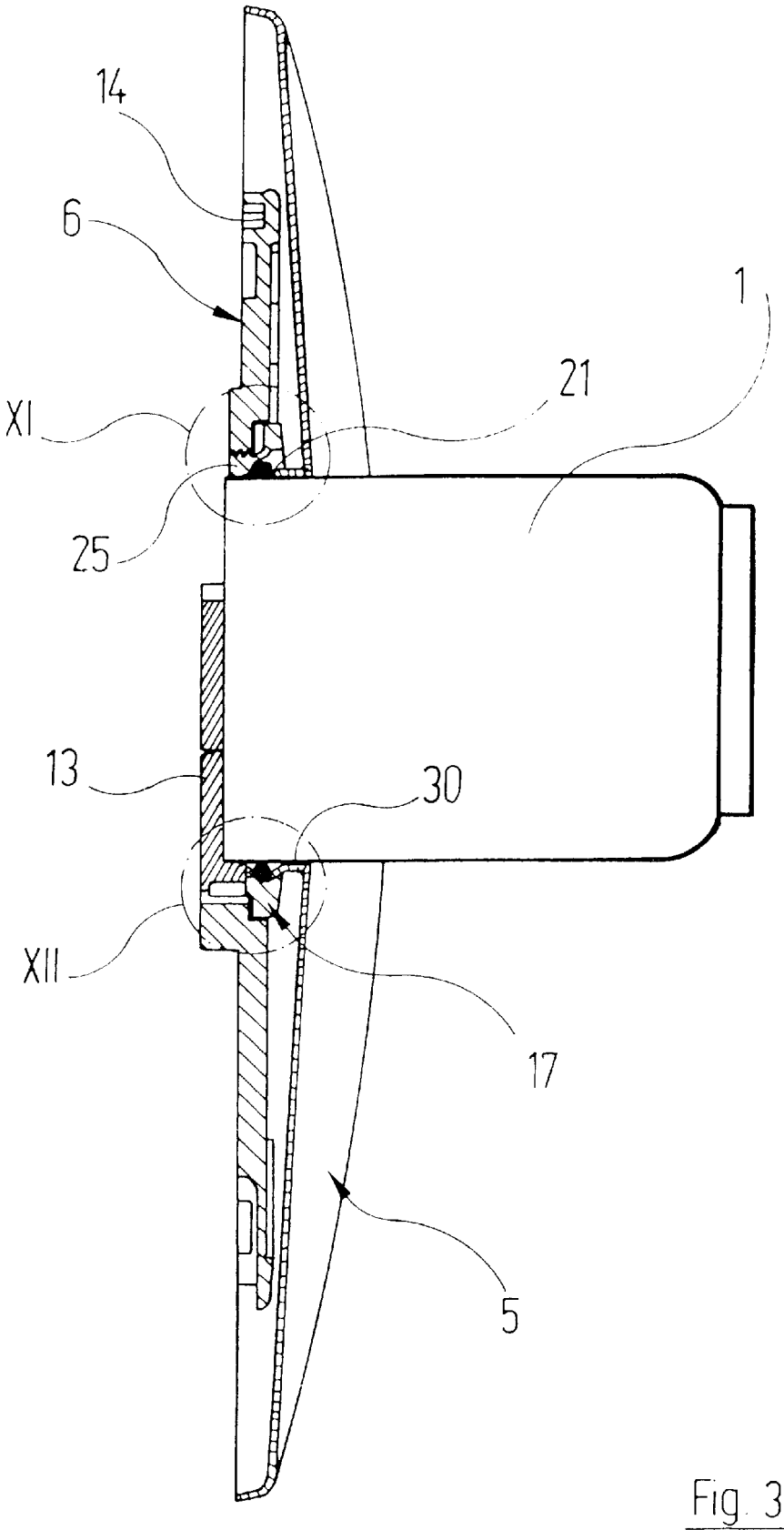
Figure 4:
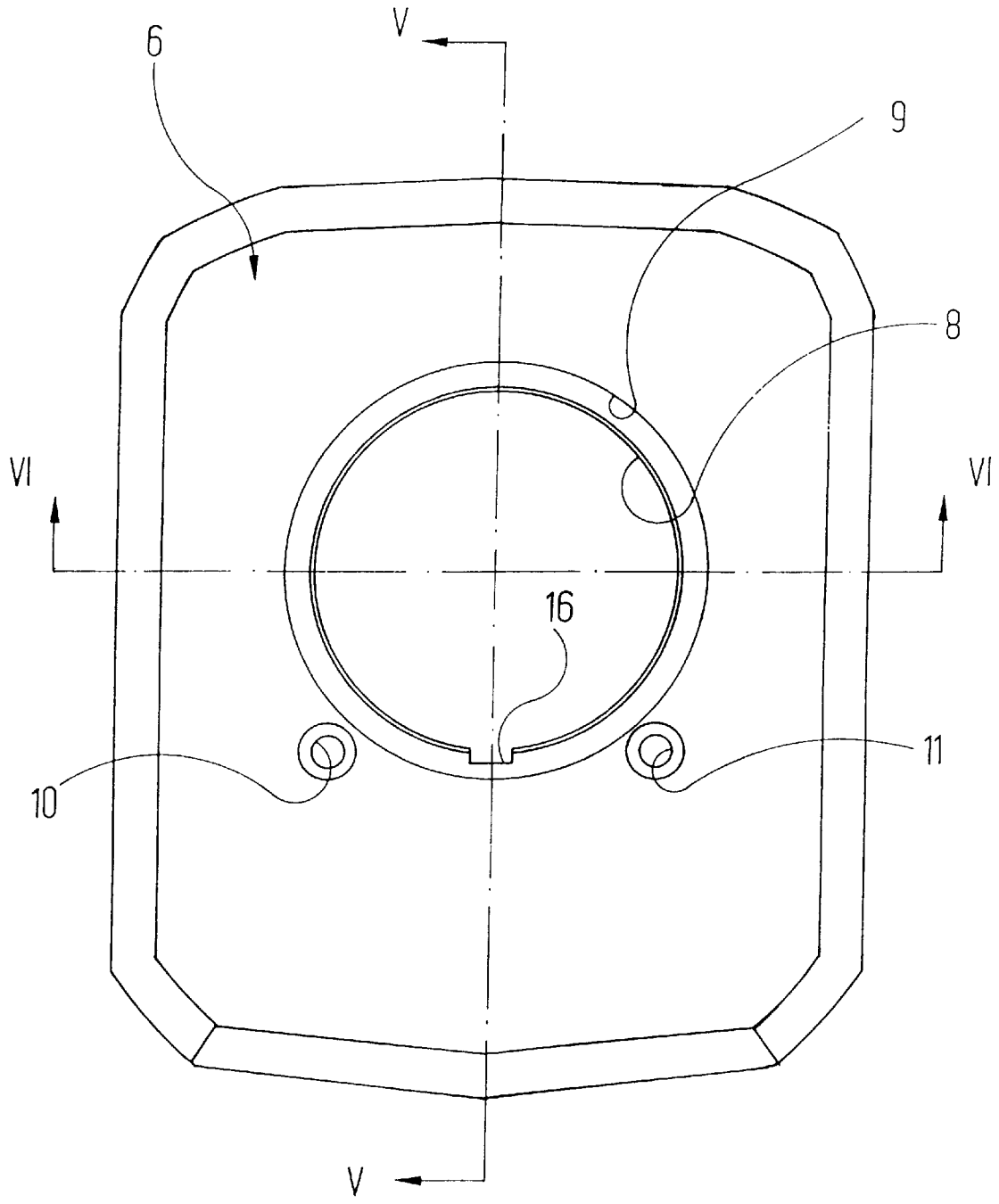
Figure 6:
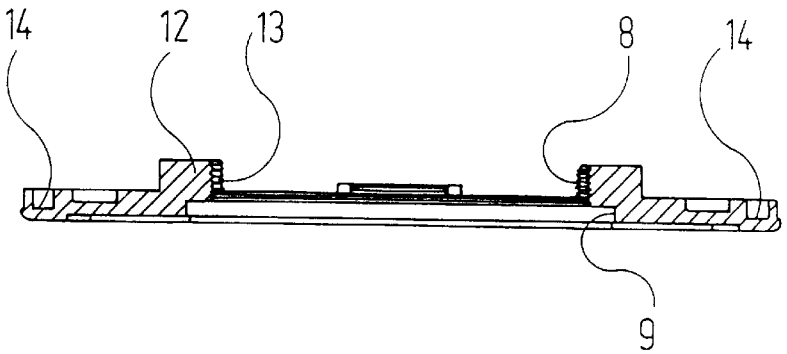
Figure 5:
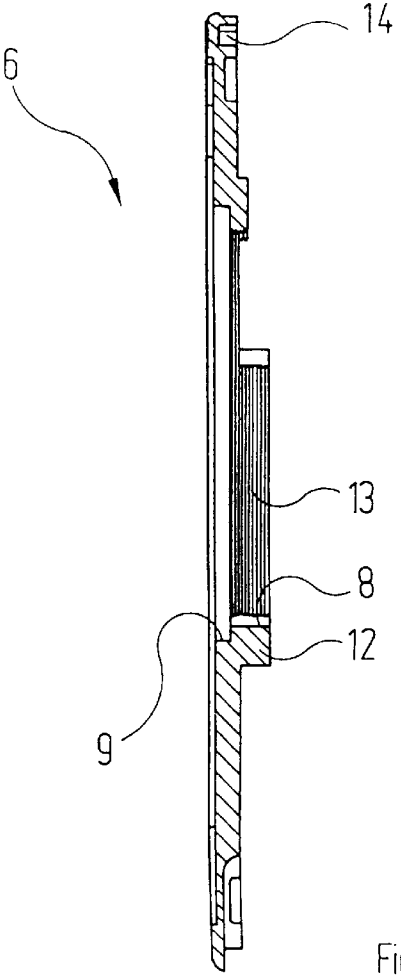
Figure 7:
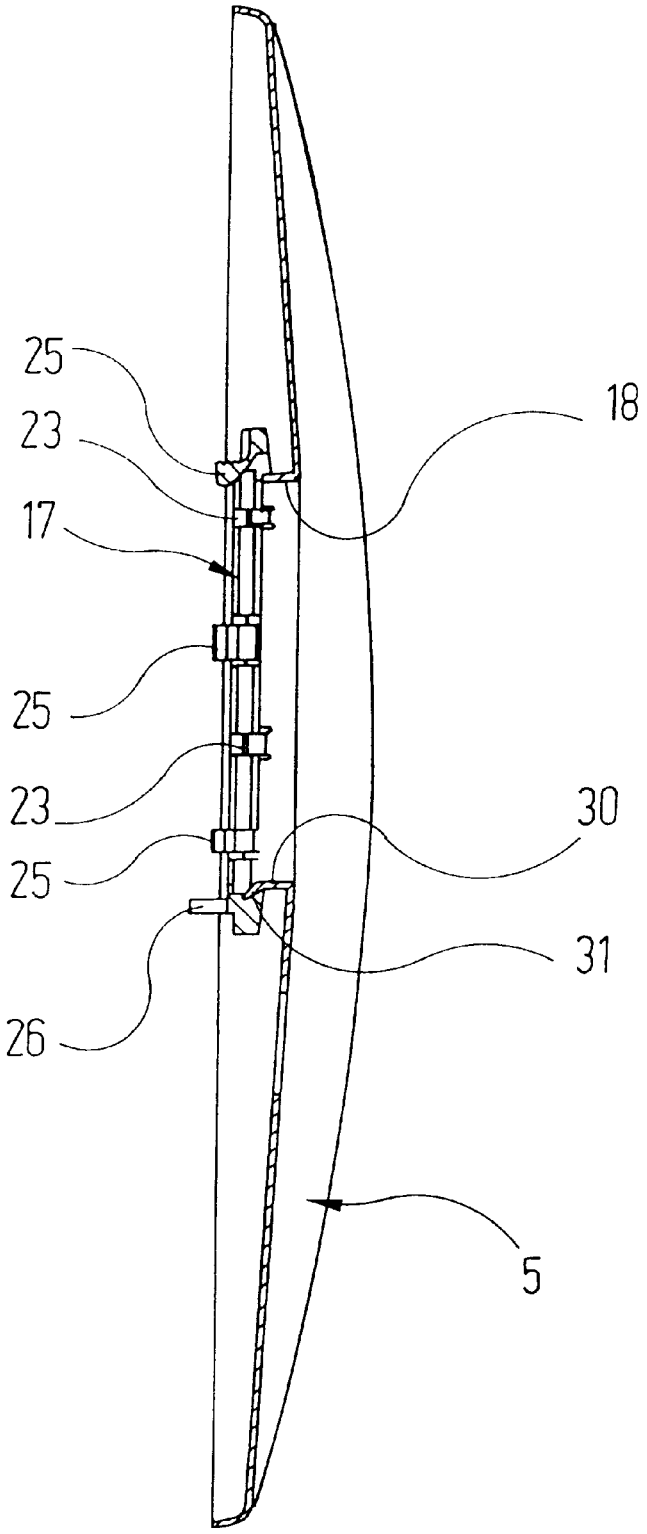
Figure 8:
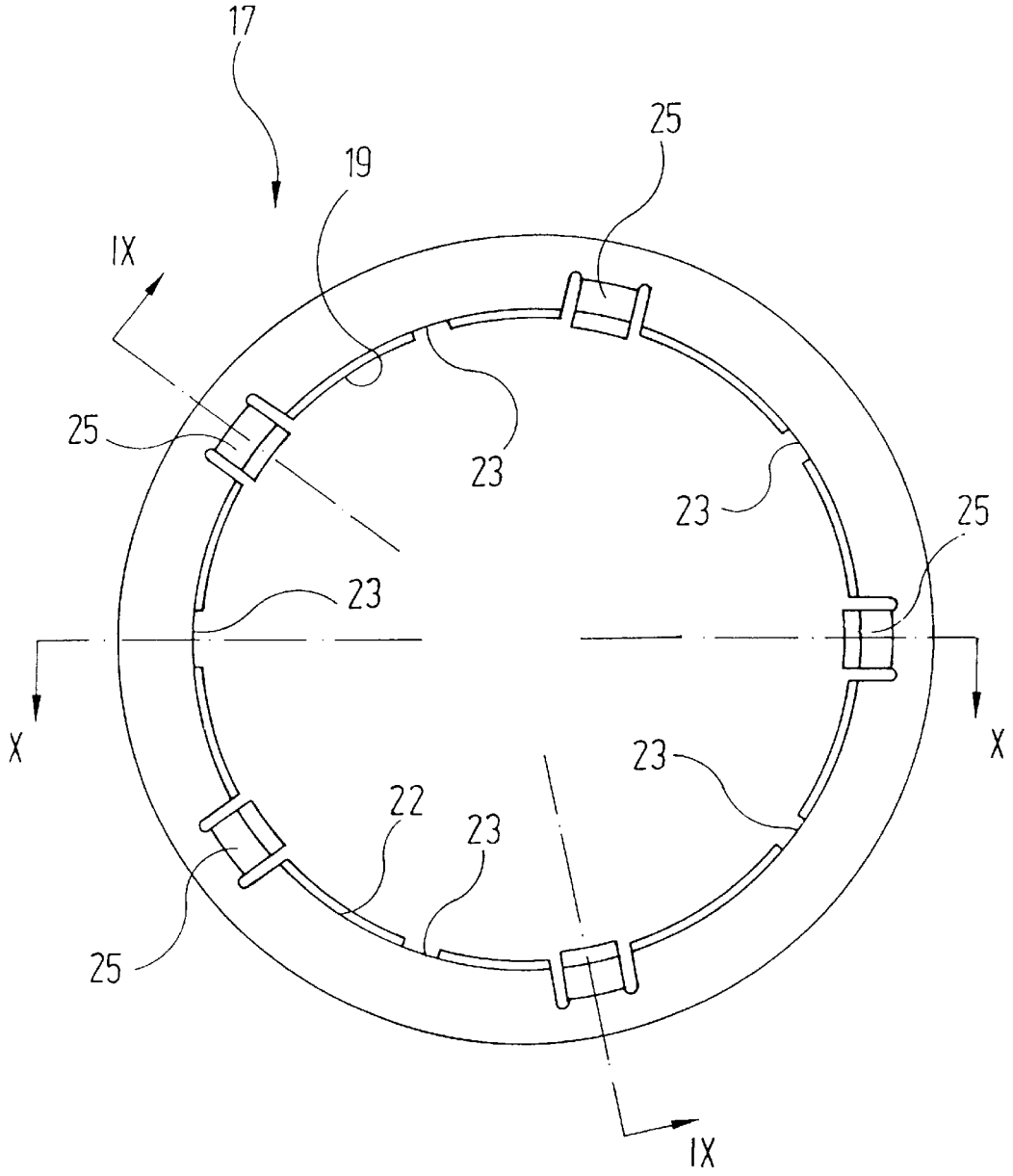
Figure 10:
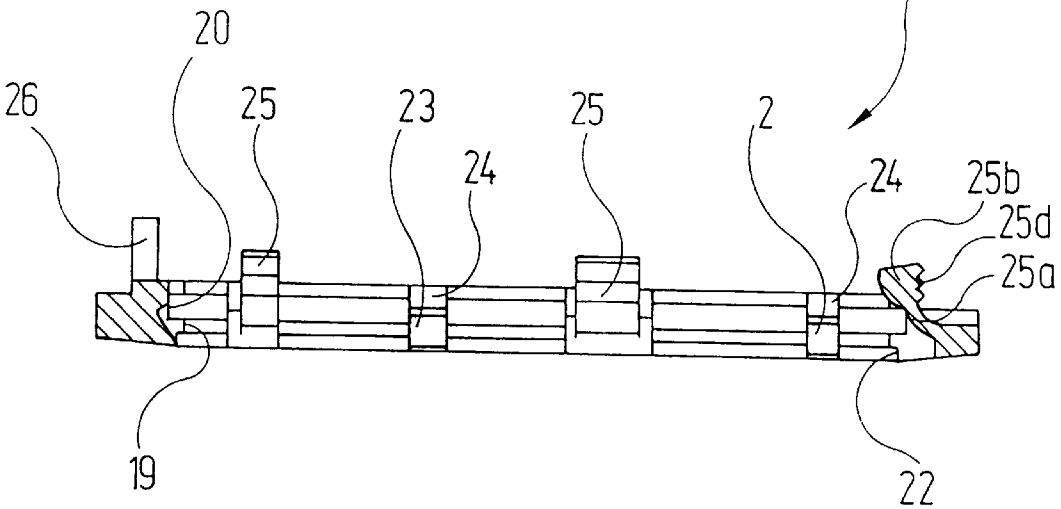
Figure 9:
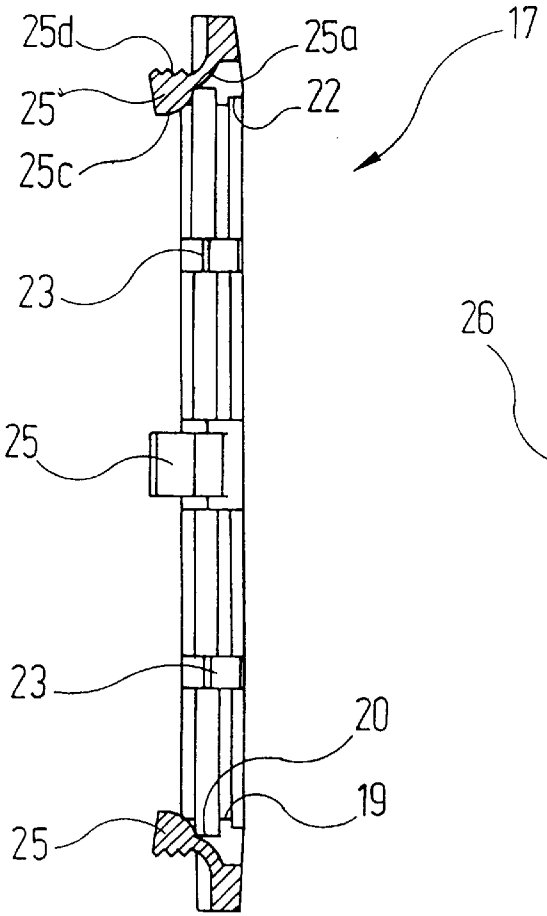
Figure 12:
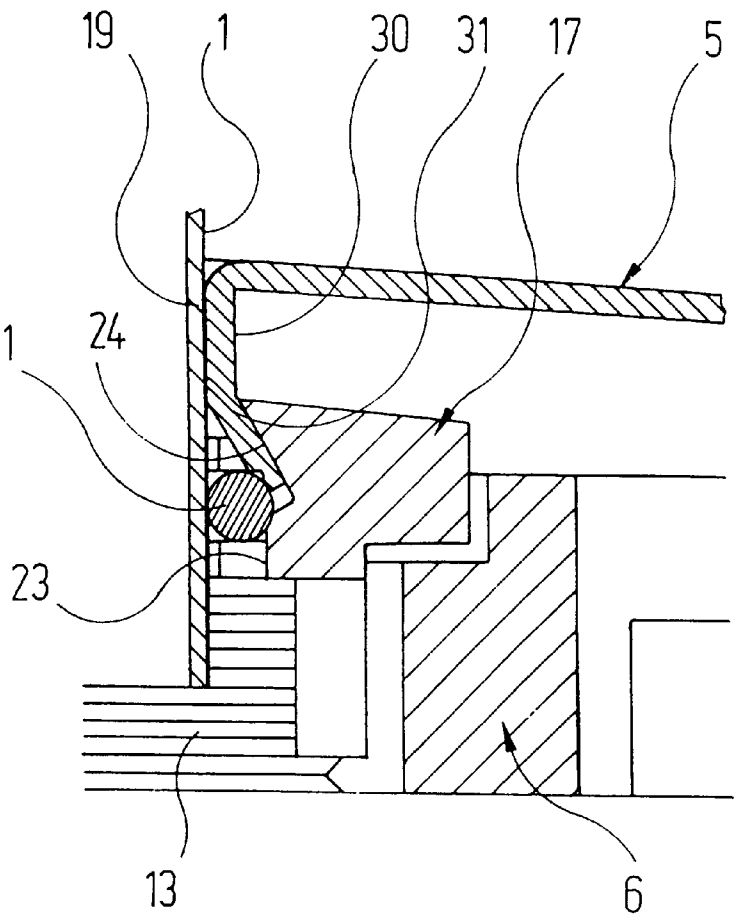
Figure 11:
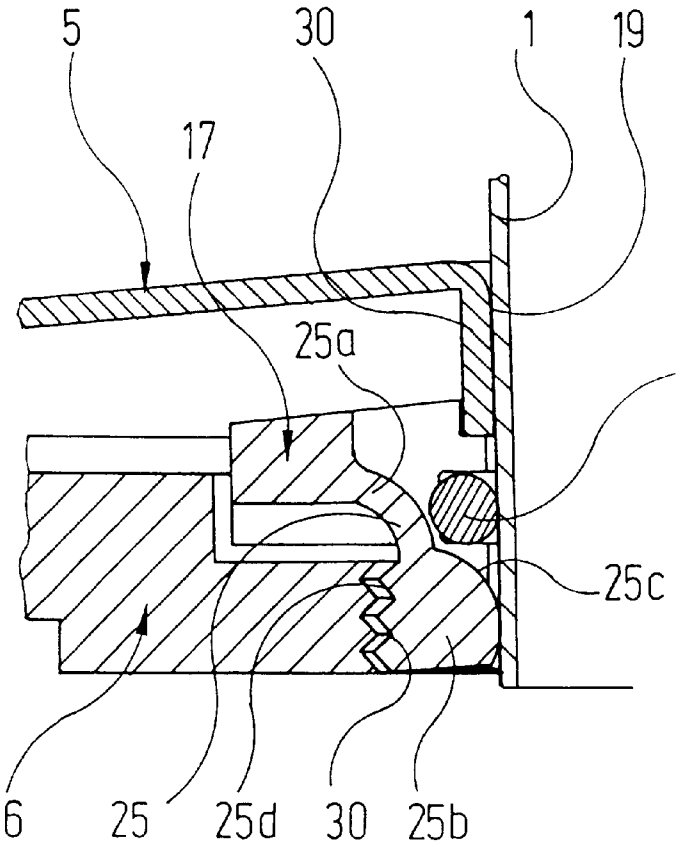

An example of an embodiment of the invention is elucidated in more detail below on the basis of the drawing; illustrated are:

FIG. 1 the top view of a covering rosette with the visible parts of the wall-fitting in the mounted state;

FIG. 2 an exploded view of the covering rosette shown in FIG. 1 and also of the visible parts of the wall-fitting;

FIG. 3 a perpendicular section through the covering rosette shown in FIG. 1 and also the ornamental cap of the wall-fitting;

FIG. 4 the front view of a covering plate which is part of the covering rosette shown in FIG. 1;

FIG. 5 a section through the covering plate shown in FIG. 4 according to the line V—V therein;

FIG. 6 a section through the covering plate shown in FIG. 4 according to the line VI—VI therein;

FIG. 7 a vertical section through the ornamental hood which is part of the covering rosette shown in FIG. 1, with a clamping ring fastened to this ornamental hood;

FIG. 8 on an enlarged scale, the top view of the clamping ring shown in FIG. 7;

FIG. 9 a section through the clamping ring shown in FIG. 8 according to the line IX—IX therein;

FIG. 10 a section through the clamping ring shown in FIG. 8 according to the line X—X therein;

FIG. 11 an enlarged detail from FIG. 3 in the region of the circle XI therein;

FIG. 12 an enlarged detail from FIG. 3 in the region of the circle XII therein.

First of all, reference is made to FIG. 1. The latter shows, in top view, the visible parts of a sanitary wall-fitting, in the present case a flush-mounted thermostat valve, protruding from the wall, namely an ornamental cap 1, a volume-regulating handle 2 and also a temperature-adjusting handle 3. The ornamental cap 1 surrounds a neck region of the wall-fitting, which is not represented in the drawing. It penetrates a covering rosette which is characterised overall by the reference symbol 4 and of which only an ornamental hood 5 can be discerned in FIG. 1. The covering rosette 4 serves in known manner for covering the installation space for the wall-fitting in the mounting-wall towards the outside.

FIG. 2 represents an exploded view of the covering rosette 4 and also of the various elements of the wall-fitting which are visible in FIG. 1. From this FIG. 2 it can be gathered that the covering rosette 4 comprises, besides the ornamental hood 5 already mentioned, a covering plate 6. This covering plate 6 abuts, in known manner, the outer surface of the mounting-wall, spans the installation space for the parts of the wall-fitting which are situated beneath plaster, and is fastened by screws 7 to the housing region of the wall-fitting which is located within the installation space. The ornamental hood 5 is detachably fastened to the covering plate 6 in a manner in which no fastening elements are visible (FIG. 1) and which is described below on the basis of FIGS. 3 to 12.

The covering plate 6 is represented in more detail in FIGS. 4 to 6. It exhibits a passage opening 8, the diameter of which is larger by a definite amount than the outside diameter of the ornamental hood 1. On the side facing away from the mounting-wall the passage opening 8 possesses a region 9 which is enlarged in diameter.

Below the passage opening 8 two passage bores 10, 11 for receiving the fastening screws 7 extend through the covering plate 6.

On the side facing towards the mounting-wall—that is to say, on the right-hand side in FIG. 5 and on the upper side in FIG. 6—a cylindrical collar 12 is moulded onto the covering plate 6, coaxially with the passage opening 8. In the embodiment represented, this cylindrical collar 12 does not extend over a full 360° but only over a certain angular range; the reasons for this are of no interest in the present context. The circumferential surface of the passage opening 8, which by virtue of the cylindrical collar 12 is given a greater axial extent at least in some regions, is provided as latching face 13 with a plurality of circular flutes. Into the surface of the covering plate 6 facing towards the wall there is moulded in the edge region, in addition, a peripheral groove 14 which serves to receive an O-ring 15 (cf. FIG. 2). In the mounted position the O-ring 15 seals the covering plate 6 in relation to the outer surface of the mounting-wall.

Moulded in the lower region of the passage opening 8 (cf. FIG. 4) is an axial groove 16, the point of which will become clear further below.

FIG. 7 shows, in vertical section, the ornamental hood 5 of the covering rosette 4 as well as a clamping ring 17 which is fastened to the ornamental hood 5, which in turn again serves for detachable mounting on the covering plate 6 of the unit consisting of ornamental hood 5 and clamping ring 17.

The ornamental hood 5 likewise exhibits a passage opening 18 through which the ornamental cap 1 of the wall-fitting extends in the mounted position represented in FIG. 3. The diameter of this passage opening 18 corresponds to the outside diameter of the ornamental cap 1. The passage opening 18 is limited by a cylindrical neck 30 extending towards the mounting-wall. Onto the outer edge of the neck 30 there are moulded, at angular distances relative to one another, several shackles 31 which serve, in a manner yet to be described, for dovetailing with the clamping ring 17.

The precise structural design of the clamping ring 17 which is manufactured from synthetic material is represented in FIGS. 8 to 10 on an enlarged scale in comparison with FIG. 7.

The inside diameter of the clamping ring 17 is slightly larger than the outside diameter of the ornamental cap 1. Into the inner circumferential surface 19 of the clamping ring 17 there is moulded a groove 20 which serves to receive an O-ring 21 (cf. FIGS. 3, 11 and 12). On the side facing towards the ornamental hood 5 the passage opening 18 in the clamping ring 17 exhibits a region 22 of enlarged diameter which corresponds to the outside diameter of the neck 30 of the ornamental hood 5. In addition, fastening recesses 23 are moulded into the inner circumferential surface 19 of the clamping ring 17 at certain angular distances from one another. Said fastening recesses are provided in their upper region facing towards the ornamental hood 5 with conical flanging faces 24 which recede with increasing distance from the axis of the clamping ring.

In addition, there are moulded onto the clamping ring 17 at certain angular distances elastic spring shackles 25 which exhibit a connecting section 25*a* pointing away from the ornamental hood 5 and a latching section 25*b* which is enlarged in wall thickness. The dimensioning of the spring shackles 25 is such that in the tension-free state represented in FIGS. 8 to 10 the radially inner boundary surfaces 25*c* of the latching regions 25*b* are situated on a circle that is smaller than the outside diameter of the ornamental cap 1 of the sanitary fitting. The radially outer boundary surfaces 25*d* of the spring shackles 25 likewise take the form of latching faces and, to this end, bear a plurality of parallel flutes. The elevations between these flutes have a diameter that corresponds to the diameter of the elevations situated between the flutes of the latching face 13 of the covering plate 6.

In addition, there is moulded onto the clamping ring 17 in an angular position a positioning projection 26 which likewise points away from the ornamental hood 5, accordingly in the direction towards the covering plate 6 in the mounted position.

Already at the manufacturing stage the clamping ring 17 is connected to the ornamental hood 5 so as to form the unit shown in FIG. 7, in that the shackles 31 of the ornamental hood 5 are introduced into the fastening recesses 23 of the clamping ring 27 and are pressed outwards there over the inclined flanging faces 24 (cf. in particular FIG. 12).

Mounting of the covering rosette 4 and of the visible elements 1, 2, 3 of the wall-fitting to the mounting-wall is effected as follows (cf. in particular FIGS. 2 and 3):

Firstly the covering plate 6 is screwed, with the aid of the screws 7, to the region of the fitting housing situated within the installation opening in the mounting-wall; the covering plate 6 is then situated above this installation opening. The unit consisting of ornamental hood 5 and clamping ring 17 is then pushed onto the covering plate 6. The positioning projection 26 thereby penetrates into the groove 16 of the covering plate 6 and ensures that the angular orientation of the ornamental hood 5 in relation to the covering plate 6 is correct. At the same time, the spring shackles 25 of the clamping ring 17 penetrate into the passage opening 8 in the clamping plate 6, whereby the fluted latching face 25*d* of the spring shackles 25 slides past the corresponding fluted latching face 13 of the covering plate 6 without engaging the latter. In this state the ornamental hood 5 can accordingly be moved in relation to the covering plate 6 by virtue of a very small force.

In the next step the ornamental cap 1 of the wall-fitting is pushed through the passage opening 18 in the ornamental hood 5 and then through the passage opening 19 in the clamping ring 17. The latching regions 25*d* of the spring shackles 25 situated in the path of movement of the ornamental cap 1 are pressed outwards by reason of the spherically convex design of the radially inner boundary surfaces 25*c*. Now the latching structures on the radially outer circumferential surface 25*d* of the spring shackles 25 of the clamping ring 17 and the latching structures on the latching face 13 of the covering plate 6 engage one another: the ornamental hood 18 can now no longer be removed from the covering plate 6 by axial traction. The type of "locking" which is formed in this manner between the clamping ring 17, and hence also the ornamental hood 5, and the covering plate 6 can be clearly discerned in FIG. 11. From the latter it can also be gathered how, in this mounted state, the O-ring 21 situated in the groove 20 of the clamping ring 17 establishes a seal in relation to the ornamental cap 1 and simultaneously brakes the axial displacement thereof.

In a conclusive mounting step the volume-regulating handle 2 and the temperature-adjusting handle 3 are fitted onto the corresponding parts of the wall-fitting which extend through the ornamental cap 1 and which are not expressly represented in the drawing.

If the covering rosette 4 is to be removed from the mounting-wall, for example in order to gain access to the part of the wall-fitting located in the installation space of the mounting-wall, then the handles 3 and 2 should be taken off from the wall-fitting in reverse sequence. The ornamental cap 1 is then drawn axially out of the clamping ring 17 and out of the ornamental hood 5. By reason of their elasticity the spring shackles 25 of the clamping ring 17 spring back again into their position which is represented in FIGS. 9 and 10, in which their latching structures on the face 25*d* are no longer in engagement with the latching structures on the face 13 of the covering plate 6.

In a second embodiment example, which is not represented in the drawing, the relationships in the region of the spring shackles are slightly modified: here these spring shackles are so designed that in the tension-free state they are already able to engage the corresponding latching structures pertaining to the covering plate. By appropriate setting of the sides of the flutes which form the latching structures on the spring shackles and in the covering plate, here too it is possible for the ornamental hood of the covering rosette to be detached from the covering plate 6 by axial traction, as long as the ornamental cap of the sanitary fitting is not inserted. For this purpose a certain force has to be expended which is required in order to detach the spring shackles out of the latching structures pertaining to the covering cap. For this purpose a certain movement of the spring shackles radially inwards is required. If, on the other hand, the ornamental cap 1 of the sanitary fitting is inserted into the clamping ring, the spring shackles cannot execute this radial movement inwards, so that, also in this case with the ornamental cap inserted, the clamping ring and hence the ornamental hood can no longer be detached from the covering plate.

What is claimed is:

1. Covering rosette for a sanitary flush-mounted fitting with a covering plate which is capable of being fastened to the flush-mounted fitting and with an ornamental hood which is detachably fastened to the covering plate, whereby covering plate and ornamental hood exhibit coaxial passage openings for a region of the flush-mounted fitting onto which an ornamental cap is capable of being pushed from outside, characterised in that on the covering plate (6) and/or on the ornamental hood (5) at least one spring shackle (25) is provided, the boundary surface (25*c*) of which pointing towards the axis of the passage openings (8, 19) pertaining to covering plate (6) and ornamental hood (5) is situated in the tension-free state on a circle which is concentric with the passage openings (8, 19), the diameter of which circle is equal to or smaller than the outside diameter of the push-on ornamental cap (1), and which on the boundary surface (25*d*) pointing away from the axis of the passage opening (8, 19) exhibits a latching device which interacts with a complementary latching device (30) on the respective other part (ornamental hood (5) or covering plate (6)) in such a manner that with the ornamental cap (1) pushed on the latching devices (25*d*, 30) cannot be detached from one another.

2. Covering rosette according to claim 1, characterised in that the boundary surface (25*c*) of the spring shackle (25) pointing towards the axis of the passage openings (8, 19) is situated in the tension-free state on a circle, the diameter of which is smaller than the outside diameter of the ornamental cap (1) to be pushed on, and in that this boundary surface (25*c*) is of spherically convex design.

3. Covering rosette according to claim 1, characterised in that the boundary surface (25*c*) of the spring shackle (25) pointing towards the axis of the passage openings (8, 19) is situated in the tension-free state on a circle, the diameter of which is smaller than the outside diameter of the ornamental cap (1), and in that the interacting latching devices (25*d*, 30) do not engage one another in the tension-free state.

4. Covering rosette according to claim 1 characterised in that the interacting latching devices (25*d*, 30) are formed by a plurality of flutes situated on a cylindrical circumferential surface.

5. Covering rosette according to claim 1 characterised in that a plurality of spring shackles (25) are formed integrally with a clamping ring (17) which is fastened to the covering plate (6) or to the ornamental hood (5).

6. Covering rosette according to claim 5, characterised in that the ornamental hood (5) is flange-mounted on the clamping ring (17).

7. Covering rosette according to claim 5, characterised in that each spring shackle (25) exhibits a curved transition region (25*a*) which at its one end is moulded onto the ring body of the clamping ring (17) and at the other end is connected to a latching region (25) which bears the boundary surface (25*c*, 25*d*) pointing relatively towards the axis of the passage openings (8, 19) and pointing away from the axis of the passage openings (8, 19).

8. Covering rosette according to claim 5, characterised in that on the inner circumferential surface of the clamping ring (17) a groove (20) is formed in which an O-ring (21) is situated.

* * * * *